US010900616B2

(12) United States Patent
Van Bommel et al.

(10) Patent No.: US 10,900,616 B2
(45) Date of Patent: Jan. 26, 2021

(54) LIGHT EMITTING DEVICE

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/327,994

(22) PCT Filed: Aug. 29, 2017

(86) PCT No.: PCT/EP2017/071653
§ 371 (c)(1),
(2) Date: Feb. 25, 2019

(87) PCT Pub. No.: WO2018/041826
PCT Pub. Date: Mar. 8, 2018

(65) Prior Publication Data

US 2019/0226644 A1 Jul. 25, 2019

(30) Foreign Application Priority Data

Sep. 1, 2016 (EP) ..... 16186816

(51) Int. Cl.
*F21S 4/00* (2016.01)
*F21K 9/232* (2016.01)
(Continued)

(52) U.S. Cl.
CPC ..... *F21K 9/232* (2016.08); *F21K 9/60* (2016.08); *F21K 9/66* (2016.08); *F21K 9/64* (2016.08);
(Continued)

(58) Field of Classification Search
CPC ..... F21Y 2113/20; F21Y 2115/00; F21Y 2115/10; F21K 9/232
See application file for complete search history.

(56) References Cited

U.S. PATENT DOCUMENTS 10,026,874 B1 * 7/2018 Li ..... H01L 33/504
2011/0310587 A1 * 12/2011 Edmond ..... G02B 5/02 362/84
(Continued)

FOREIGN PATENT DOCUMENTS

CN 104154444 A 11/2014
CN 204313016 U * 5/2015
(Continued)

*Primary Examiner* — Matthew J. Peerce
(74) *Attorney, Agent, or Firm* — Daniel J. Piotrowski

(57) ABSTRACT

A light emitting device (1) having a longitudinal axis (A) comprising at least one LED light source (8, 9) adapted for, in operation, emitting first light, at least one LED filament (4, 5, 6, 7) adapted for, in operation, emitting second light, at least one translucent core element (2), the translucent core element comprising a circumferential wall (3), an inner space (21) enclosed by the circumferential wall, and an outer bulb (13) enclosing the at least one translucent core element (2) and the at least one LED filament (4, 5, 6, 7), wherein the at least one LED light source (8, 9) being arranged in the inner space enclosed by the circumferential wall of the translucent core element, and the at least one LED filament (4, 5, 6, 7) being arranged outside of the at least one translucent core element, and wherein the at least one translucent core element (2) is centrally arranged on the longitudinal axis (A).

13 Claims, 8 Drawing Sheets

(51) Int. Cl.

| | |
|---|---|
| ***F21K 9/60*** | (2016.01) |
| ***F21K 9/66*** | (2016.01) |
| *F21Y 115/10* | (2016.01) |
| *F21Y 113/20* | (2016.01) |
| *F21K 9/64* | (2016.01) |
| *F21Y 113/13* | (2016.01) |
| *F21Y 107/40* | (2016.01) |
| *F21Y 107/30* | (2016.01) |
| *F21K 9/68* | (2016.01) |
| *F21Y 107/00* | (2016.01) |

(52) U.S. Cl.
CPC ..... *F21K 9/68* (2016.08); *F21Y 2107/00* (2016.08); *F21Y 2107/30* (2016.08); *F21Y 2107/40* (2016.08); *F21Y 2113/13* (2016.08); *F21Y 2113/20* (2016.08); *F21Y 2115/10* (2016.08)

(56) References Cited

U.S. PATENT DOCUMENTS

| | | | | |
|---|---|---|---|---|
| 2012/0014111 | A1 | 1/2012 | Welten | |
| 2012/0217862 | A1 | 8/2012 | Matsuda et al. | |
| 2015/0009673 | A1* | 1/2015 | Wu | F21V 9/30 362/293 |
| 2015/0036341 | A1* | 2/2015 | Ge | F21V 13/08 362/240 |
| 2016/0356461 | A1* | 12/2016 | Lai | F21V 19/003 |

FOREIGN PATENT DOCUMENTS

| | | | |
|---|---|---|---|
| CN | 205316084 | U | 6/2016 |
| JP | 2012022802 | A | 2/2012 |
| JP | 2014182995 | A | 9/2014 |
| JP | 2015515087 | A | 5/2015 |
| JP | 2016091961 | A | 5/2016 |

* cited by examiner

LIGHT EMITTING DEVICE

CROSS-REFERENCE TO PRIOR APPLICATIONS

This application is the U.S. National Phase application under 35 U.S.C. § 371 of International Application No. PCT/EP2017/071653, filed on Aug. 29, 2017 which claims the benefit of European Patent Application No. 16186816.1, filed on Sep. 1, 2016. These applications are hereby incorporated by reference herein.

FIELD OF THE INVENTION

The invention relates to a light emitting device comprising at least one LED light source adapted for, in operation, emitting first light, at least one LED filament adapted for, in operation, emitting second light, and at least one translucent core element, the translucent core element comprising a circumferential wall.

BACKGROUND OF THE INVENTION

Incandescent lamps are rapidly being replaced by LED based lighting solutions. It is nevertheless appreciated and desired by users to have retrofit lamps which have the look of an incandescent bulb. For this purpose, one can simply make use of the infrastructure for producing incandescent lamps based on glass and replace the filament with LEDs emitting white light. One of the concepts is based on LED filaments placed in such a bulb. The appearances of these lamps are highly appreciated as they look highly decorative.

One such LED based solution is known from US 2012/0217862 A1, describing a light bulb type lamp comprising a LED module having a translucent board in the shape of a plate and a plurality of LEDs mounted on the board such as to form two lines of LEDs. The LED module further comprises a sealing component for sealing the LEDs such that the lines of LEDs, when in operation, give the impression of a filament. The LED module further comprises lines, wiring and power supply for the LEDs.

However, for such known solutions, when the intensity of the LED filament is increased the result is too much glare in the output of the lamp.

CN 204 227 147 U discloses a large-angle-lighting LED lamp which comprises a lamp holder, a lamp cover and a plurality of LED lamp filaments. A circuit board is arranged at the tail end of the lamp holder, the lamp cover is fixedly connected with the lamp holder, the LED lamp filaments are positioned in the lamp cover, a fixed retaining plate is clamped at an opening end of the lamp holder, a fixing seat for fixing a light emitting element is arranged on the fixed retaining plate and comprises a supporting column and multiple clamping grooves formed around the supporting column, the light emitting element comprises multiple light emitting boards and a fixing board playing a role in binding the light emitting boards, the ends of the light emitting boards are clamped in the clamping grooves of the fixing seat, the LED lamp filaments are all directly encapsulated in a transparent glass substrate respectively, elastic piece terminals are arranged at two ends of each LED lamp filament after being encapsulated, and each LED lamp filament is fixed on the supporting column through the corresponding elastic piece terminals in a manner of inclining for a certain angle theta. The large-angle-lighting LED lamp is convenient to assemble and easy in changing of light emitting power.

US 2015/036341 A1 discloses a LED light-emitting column and a LED light using the same. The LED light-emitting column comprises a high thermal conductivity tube and at least one series of LED chips disposed on an outer surface of the high thermal conductivity tube. The LED light comprises a light-transmitting bulb shell vacuum-sealed and filled with a heat dissipation and protection gas, a LED driver and an electrical connector. The LED light-emitting column is fixed within the bulb shell. Electrical lead of the LED light-emitting column is connected with an outer power supply through the driver and the electrical connector. The LED light is a single bulb shell light, a multi-tube light or a U-type light.

CN 204 573 678 U discloses an easy-to-install LED bulb. The LED bulb includes a lamp cap, a drive power supply assembly and a lamp cover. The LED bulb comprises a plurality of LED filaments, each LED filament is positioned at a non-zero distance to the longitudinal axis.

SUMMARY OF THE INVENTION

It is an object of the present invention to overcome this problem, and to provide a light emitting device that does not produce, or only to a very limited degree produces, glare when the intensity of the at least one LED filament is increased.

A further object of the present invention is to provide a light emitting device that is more versatile in terms of allowing more different lighting configurations and in terms of allowing operation at more different intensities without experiencing glare.

According to a first aspect of the invention, this and other objects are achieved by means of a light emitting device having a longitudinal axis (A) comprising at least one LED light source adapted for, in operation, emitting first light, at least one LED filament adapted for, in operation, emitting second light, and at least one translucent core element, the translucent core element comprising a circumferential wall, an inner space enclosed by the circumferential wall, and an outer bulb enclosing the at least one translucent core element and the at least one LED filament, wherein the at least one LED light source being arranged in the inner space enclosed by the circumferential wall of the translucent core element, and the at least one LED filament being arranged outside of the at least one translucent core element, and wherein the at least one translucent core element is centrally arranged on the longitudinal axis.

The term LED filament as used herein is to be understood broadly as a light source based on LEDs and having the appearance of being shaped as a filament. Typically, a LED filament comprises a substrate shaped generally as a filament, and thus having an elongated body, and a plurality of LEDs mechanically coupled to the substrate. The plurality of LEDs of the LED filament may be covered by a phosphor.

Thereby, and in particular by providing both a LED light source inside of and a LED filament outside of the translucent core element, a light emitting device that does not produce, or only to a very limited degree produces, glare when the intensity of the at least one LED filament is increased is provided.

Arranging the LED filaments outside of the translucent core element has the further effect that the LED filaments can be seen in the off state of the light emitting device, and that the LED filaments are still visible in front of the light emitting device when the light is turned on. Thereby, a particularly well functioning and aesthetically pleasing retrofit lamp which has the look of an incandescent bulb is provided for.

A further advantage of providing both a LED light source inside of and a LED filament outside of the translucent core element is that it becomes possible to operate the LED light source and the LED filament independently of one another. This in turn provides a light emitting device with which operation at more different intensities without experiencing any significant glare becomes possible.

Furthermore, and in particular by on the one hand providing at least one LED filament outside of the translucent core element and on the other hand providing the translucent core element as a translucent element comprising a circumferential wall and an inner space enclosed by the circumferential wall, it becomes possible to alter the shape of the LED filaments and/or of the translucent core element as desired. Thereby a light emitting device that is much more versatile in terms of allowing more different lighting configurations while still not experiencing any significant glare.

In an embodiment the at least one LED filament is arranged on or at the translucent core element.

Thereby a light emitting device with a particularly robust construction is provided for, as the translucent core element may form a direct or indirect support for the LED filament(s).

In embodiments where the translucent core element forms an indirect support for the LED filament(s), one or more connection elements may be provided on the translucent core element for connection of the LED filaments.

In an embodiment the at least one LED filament is extending in parallel with the longitudinal axis.

In an alternative embodiment the at least one LED filament is tilted with respect to the longitudinal axis.

Thereby a light emitting device that is even more versatile in terms of allowing more different lighting configurations is provided for.

In an embodiment the ratio of the intensity of the second light emitted by the at least one LED filament to the intensity of the light emitted from the translucent core element is more than 3, more than 4, or more than 5. For intensity ratios lower than 3, a significant amount of glare is experienced.

Thereby a light emitting device that does not produce, or only to a particularly limited degree produces, glare when the intensity of the at least one LED filament is increased is provided for.

In an embodiment the light emitting device comprises a plurality of LED filaments, the plurality of LED filaments being arranged equally spaced around the translucent core element.

Thereby a light emitting device with which the light emitted by the LED filaments is evenly distributed on the surface of the outer bulb is provided for. Furthermore, a homogeneous and preferably omnidirectional light distribution in the far field is obtained. Such a configuration furthermore ensures an even further reduction in the amount of glare produced as well as a homogenous intensity distribution of the light emitted by the light emitting device irrespective of the angle of view.

In an embodiment the light emitting device comprises at least one further LED filament, the at least one further LED filament being arranged in the inner space enclosed by the circumferential wall of the translucent core element.

Thereby a light emitting device capable of producing an output with a higher intensity while still achieving the above mentioned advantages related particularly to glare is provided for. Also, an even more convincing retrofit light bulb is obtained in this way.

In an embodiment the translucent core element comprises a scattering material, and wherein the concentration of the scattering material is higher at the position of the at least one LED filament than at the remaining part of the translucent core element.

In an embodiment the translucent core element comprises a higher reflectivity and/or is more backscattering at the position of the at least one LED filament than at the remaining part of the translucent core element. For instance, a reflective or backscattering layer may be provided on the translucent core element, and in particular on an inner surface of the translucent core element, at the position of the LED filaments.

In an embodiment the circumferential wall of the translucent core element comprises a larger thickness at the position of the at least one LED filament than at the remaining part of the translucent core element.

In an embodiment the circumferential wall of the translucent core element comprises a cavity at the position of the at least one LED filament.

By any of the four above-mentioned embodiments an increase in the ratio of intensity between the LED filaments and the translucent core element is obtained, which in turn ensures an even further reduction in the amount of glare produced.

Especially providing an increased wall thickness or a decreased wall thickness (e.g. cavities) at the position of the at least one LED filament furthermore provides for a light emitting device with a core element which is particularly simple and thus inexpensive to produce.

Especially providing an increased wall thickness at the position of the at least one LED filament furthermore provides for a light emitting device with which the light effect is improved.

In an embodiment the at least one LED filament is arranged at least partially within the cavity in the translucent core element.

Thereby a further increase in the ratio of intensity between the LED filaments and the translucent core element is obtained. Furthermore, and especially with a view to the further embodiments described immediately hereinafter, an improved redirection of the second light emitted by the LED filaments is obtained.

In an embodiment the cavities are shaped and arranged such as to collimate the second light emitted by an adjacent LED filament.

In an alternative embodiment the cavities are shaped and arranged such as to distribute the second light emitted by an adjacent LED filament to angles larger than the angles of incidence of the second light on the cavities.

By any of the two above mentioned embodiments an even further increase in the ratio of intensity between the LED filaments and the translucent core element is obtained.

In an embodiment at least one of the translucent core element and the cavities comprise a luminescent material.

By providing the translucent core element and/or the cavities with a luminescent material an increase in the intensity of the light emitted by the light emitting device is obtained. Furthermore, it becomes possible to alter the color distribution of the light emitted by the light emitting device.

In an embodiment, the color point of the white light produced by the translucent core element has the same color point as the white (second) light produced by the at least one LED filament positioned outside of the translucent core element.

Thereby, a light emitting device emitting light of a homogenous color is obtained.

In an embodiment a part of the translucent core element comprises a higher transmissivity than the remaining part of the translucent core element.

For instance, the top part, i.e. the part opposite the LED light source and the socket element, of the translucent core element may be provided with a higher transmissivity than the remaining part of the translucent core element.

Thereby a light emitting device is provided with which more light is transmitted to the part of the outer bulb nearest to the part of the translucent core element having a higher transmissivity. This in turn may be employed to e.g. lower the amount of light that may otherwise be absorbed by being transmitted in direction of the socket element. Furthermore, this embodiment provides a possibility for controlling the direction in which the light with the highest intensity is to be transmitted.

In an embodiment at least an outer surface of the circumferential wall of the translucent core element is parallel with the longitudinal axis.

In an embodiment at least an outer surface of the circumferential wall of the translucent core element comprises a curvature in the longitudinal direction.

In an embodiment at least an outer surface of the circumferential wall of the translucent core element is inclined with respect to the longitudinal axis.

Furthermore, the at least one LED filament may extend in parallel with the outer surface of the circumferential wall of such a translucent core element. These embodiments provide for a light emitting device which is much more versatile in terms of allowing more different lighting configurations and lighting patterns.

In an embodiment the light emitting device further comprises any one or more of a homogenous outer bulb, a scattering coating and a socket element.

In an embodiment the light emitting device comprises a base for connecting the lighting module to a luminaire socket. The base may be a cap. The cap may be an Edison screw.

In an embodiment the light emitting device further comprises a driver. The driver is electrically coupled to the light sources. The driver is also electrically coupled to the socket element or base. The driver is configured to power the LED light sources and the LED filament.

In a further embodiment the light emitting device comprises a controller for controlling the light emitted by the LED light sources and/or the LED filament. The controller may be adapted to control any one or more of the intensity, color temperature, color and color rendering index (CRI) of the LED filament and/or LED light sources.

The light emitting device according to the invention may be a light bulb, such as an incandescent light bulb or any other type of light bulb.

The invention thus furthermore concerns a lamp or light bulb comprising a light emitting device according to the invention.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
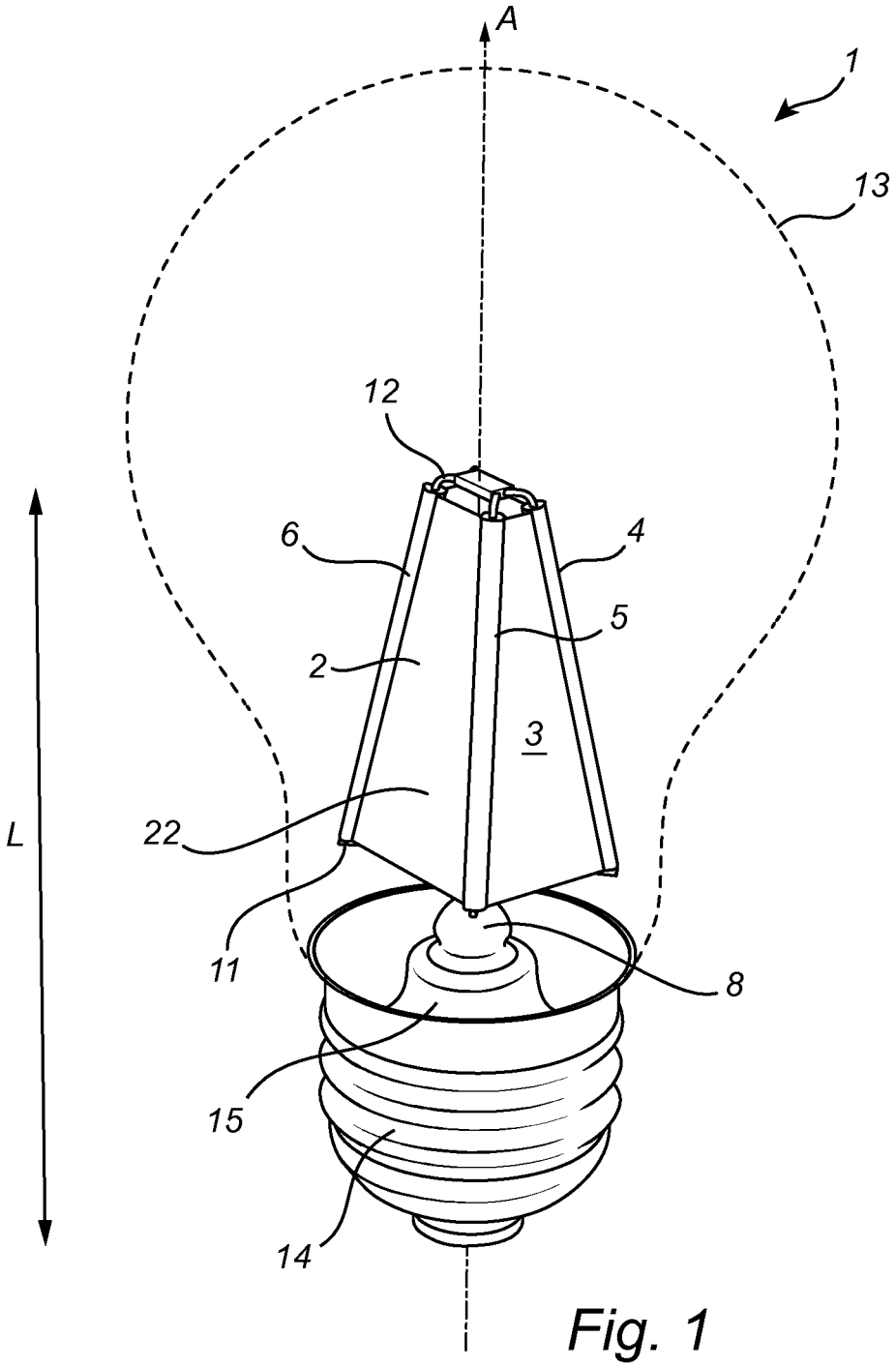
FIG. 1 shows a schematic perspective view of a first embodiment of a light emitting device according to the invention and comprising a translucent core element, a LED light source and a plurality of LED filaments.

Turning first to FIG. 1, a schematic perspective view of a first embodiment of a light emitting device 1 according to the invention is shown. The light emitting device 1 generally comprises a translucent core element 2, at least one LED light source 8, 9 adapted for, in operation, emitting first light and at least one LED filament 4, 5, 6, 7 adapted for, in operation, emitting second light.

In the embodiment shown on FIG. 1, the light emitting device 1 comprises one LED light source 8 and three LED filaments 4, 5, 6.

Figure 2:
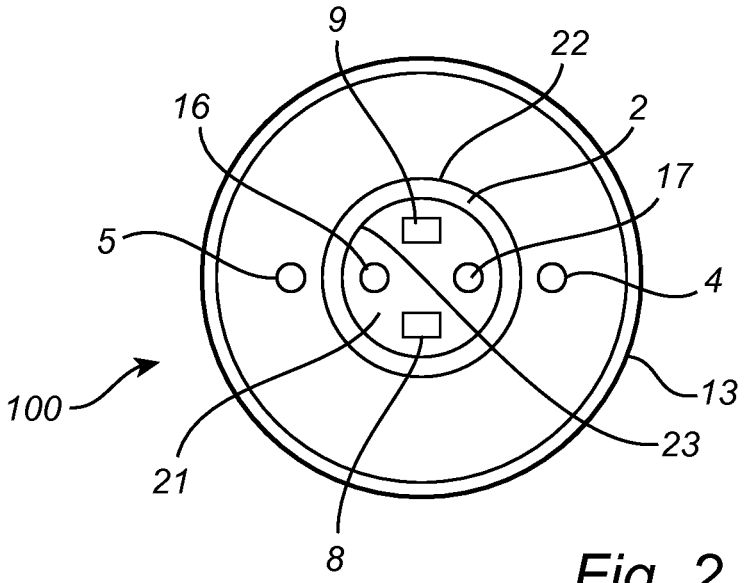
FIG. 2 shows a cross-sectional view of a second embodiment of a light emitting device according to the invention.
Figure 3:
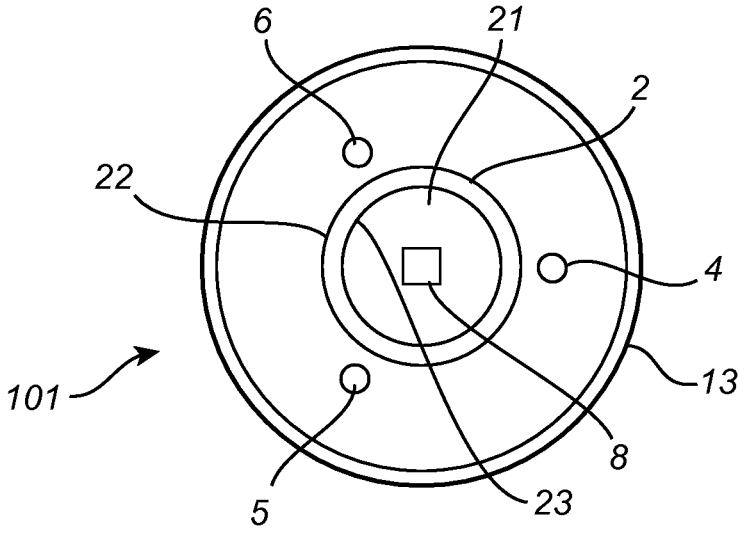
FIG. 3 shows a cross-sectional view of a third embodiment of a light emitting device according to the invention.

Referring also to FIGS. 2 and 3, generally and irrespective of the embodiment the translucent core element 2 is a translucent element and comprises a circumferential wall 3 and an inner space 21 enclosed by the circumferential wall 3. Generally, the circumferential wall 3 of the translucent core element 2 comprises an outer surface 22 and an inner surface 23.

A translucent appearance of the translucent core element 2 may be obtained by surface roughening. The inner surface 23, the outer surface 22 or both surfaces 22, 23 of the core element 2 may thus be surface roughened. A translucent appearance of the translucent core element 2 may also be obtained by inclusion of small air gaps or bubbles in the circumferential wall 3 of the translucent core element 2. A combination of these two possibilities is also feasible.

Generally and irrespective of the embodiment, the at least one LED light source 8, 9 is arranged in the inner space 21 of the translucent core element 2, and the at least one LED filament 4, 5, 6, 7 is arranged outside of the at least one translucent core element. The at least one LED filament 4, 5, 6, 7 is arranged on or at the translucent core element 2, or in other words adjacent to or in a distance from, the outer surface 22 of the circumferential wall 3 of the translucent core element 2.

The translucent core element 2 may thus form a direct or an indirect support for the LED filament(S) 4, 5, 6, 7. In some embodiments the translucent core element 2 may as illustrated in FIG. 1 be provided with connection elements 11, 12 to which the LED filament(s) 4, 5, 6, 7 may be connected. The connection elements 11, 12 may form only a physical connection or both a physical and an electrical connection to the LED filaments.

In the off state the at least one LED filament 4, 5, 6 can be seen, and when the light is turned on the at least one LED filament 4, 5, 6 is still visible in front of the light emitting translucent core element 2.

Typically, the at least one LED filament 4, 5, 6 comprises a substrate shaped generally as a filament, and thus having an elongated body, and a plurality of LEDs mechanically coupled to the substrate. The at least one LED filament 4, 5, 6 may have a length and a width chosen such that the ratio between the length and the width, length:width, is at least 3, at least 5 or even at least 7, such as 10 or even 15. For example, the length of the at least one LED filament is for example 4 or 6 cm. The width of the LED filament at least one is for example 2 mm or 3 mm.

The at least one LED light source 8, 9 and the at least one LED filament 4, 5, 6 are, especially in case the light emitting device is adapted to be dimmable, operable separately from one another. Alternatively, the at least one LED light source 8, 9 and the at least one LED filament 4, 5, 6 are operable simultaneously.

As depicted in FIG. 1, the outer bulb 13 may be centrally arranged on the longitudinal axis A. Centrally is in the middle of an object. As depicted in FIG. 1, the light emitting device 1 may comprise a single translucent core element 2. The inner space 21 may be filled with a fluid such as a gas e.g. Helium, Oxygen, and/or air.

In the embodiment shown, the light emitting device 10 further comprises a homogenous outer bulb 13 as well as a socket element 14 with electrical connectors 15 and driver electronics for LEDs (not shown), which are all optional. The homogenous outer bulb 13 may be a clear bulb or it may comprise a scattering coating which is also optional. In case a scattering coating is provided, the level of scattering should be chosen such that the filaments are visible when the light emitting device is in operation, i.e. is on.

Hence, the light emitting device 10 is in the embodiment shown a light bulb, such as an incandescent light bulb. Other types of light bulbs are, however, also feasible.

The light emitted by the light emitting device is in a particular embodiment white light. White light is preferred in most lighting applications.

To indicate the quality of whiteness a deviation from the BBL is often given. The smaller the deviation from the BBL, the smaller the differences in white point between different light sources will be. The white light may have a maximum deviation of 15 SDCM (Standard Deviation from Color Matching) from the BBL, or a maximum deviation of 10 SDCM from the BBL, or even a maximum deviation of 5 SDCM from the BBL.

The white light may have a color temperature in the range from 2.000 to 8.000 K, or a color temperature in the range from 2.500 to 6.000 K, or even a color temperature in the range from 2.700 to 5.000 K. These are the color temperatures which are most often used in lighting.

The white light may have a color rendering index, CRI, of at least 70, or a color rendering index of at least 80, or even a color rendering index of 85. The CRI is an indication of the quality of light. The higher the value of the CRI the better the quality of the light will be. Minimum specified CRI is in main lighting applications 80. Premium products have a CRI of 85+ or 90+. Some application where true representation of all the colors is not needed may have a CRI of 70+.

The white light produced by the light emitting device 1 may have a minimum lumen-output of 150 lm, or a minimum lumen-output of 200 lm, or even a minimum lumen-output of 250 lm. These are minimum lumen output levels for light bulbs. Decorative light bulbs typically have a lumen output of 150+ lm. Normal light bulbs have a lumen output of about 400 or 600 lm. High lumen light bulbs (e.g. 75 or 100 watt replacements) have a lumen output of about 750 or 1000 lm.

The color point of the white light emitted by or produced by the translucent core element 2 has preferably the same color point as the white light emitted by the at least one LED filament 4, 5, 6, 7 positioned outside of the translucent core element 2. Such a color point is needed in case a homogenous color temperature is desired. However, it is also feasible that both elements produce different color temperatures or colors, which may result in decorative lighting effects.

The height of the translucent core element 2 may be in the range from 80% to 10% of the size of the outer bulb 13, or in the range from 70% to 20% of the size of the outer bulb 13, or even in the range from 60% to 30% of the size of the outer bulb 13. The larger the height and/or the larger the surface area of the core element, the lower the intensity of the core element will be, or alternatively the more light the core element may give. For instance, the height of the envelope of the bulb is e.g. 8 cm. The height of the translucent core element may be 4 cm.

The width of the translucent core element 2 may be in the range from 80% to 10% of the size of the outer bulb 13, or in the range from 70% to 20% of the size of the outer bulb 13, or even in the range from 60% to 30% of the size of the outer bulb 13. The larger the width and/or the larger the surface area of the core element, the lower the intensity of the core element will be, or alternatively the more light the core element may give. For instance, the width of the envelope of the bulb is 6 cm. The width of the translucent core element may be 4 cm. The outer bulb may be an envelope.

Turning now to FIG. 2, a cross-sectional view of a second embodiment of a light emitting device 100 according to the invention is shown and will be described only in terms of those features that differ from the embodiment described above.

The light emitting device 100 comprises two LED filaments 4 and 5 arranged outside the translucent core element 2, for example, on both and/or diametrically opposite sides of the translucent core element 2 and parallel oriented to the longitudinal axis A of the light emitting device 100. As depicted in FIG. 1 the longitudinal axis A of the lighting device 100 may be the long axis of the light emitting device 100 running through its center such as for example its center of gravity. The light emitting device 100 further comprises two LED light sources 8, 9 arranged inside the translucent core element 2, i.e. in the inner space 21 of the translucent core element 2.

In other embodiments more than two LED light sources may be provided arranged inside the translucent core element 2.

The light emitting device 100 further comprises two further LED filaments 16 and 17 arranged inside the translucent core element 2, i.e. in the inner space 21 of the translucent core element 2. In embodiments where the light emitting device comprises two—or one or more than two—such further LED filaments, it is furthermore possible to omit the LED light source(s) 8, 9 as the further LED filaments may take the place of the LED light source(s) 8, 9.

Turning now to FIG. 3, a cross-sectional view of a third embodiment of a light emitting device 101 according to the invention is shown and will be described only in terms of those features that differ from the embodiments described above.

The light emitting device 101 comprises three LED filaments 4, 5, 6 each positioned at an angle of 120 degrees to the adjacent LED filaments and parallel oriented to the longitudinal axis A of the translucent core element 2. The light emitting device 101 further comprise one LED light source 8 arranged inside the translucent core element 2, i.e. in the inner space 21 of the translucent core element 2.

As depicted in FIG. 3, the at least one LED filament 4, 5, 6 may be arranged between the at least one translucent central core element 2 and the outer bulb 13. As depicted in FIG. 3, the at least one LED filament 4, 5, 6 may be arranged at a non-zero distance to the longitudinal axis. As depicted in FIG. 3, the at least one LED filament 4, 5, 6 may be arranged at a non-zero distance to the at least one translucent central core element 2. As depicted in FIG. 3, the at least one LED light source 8 may be arranged on the longitudinal axis A. As depicted in FIG. 3, the at least one LED light source 8 is different from a LED filament. Thus the at least one LED light source 8 is not a LED filament. As depicted in FIG. 3, the at least one LED light source 8 is not arranged outside at least one transparent core element 2. As depicted in FIG. 3, the at least one LED filament 4, 5, 6 is not arranged inside at least one transparent core element 2.

Figure 4:
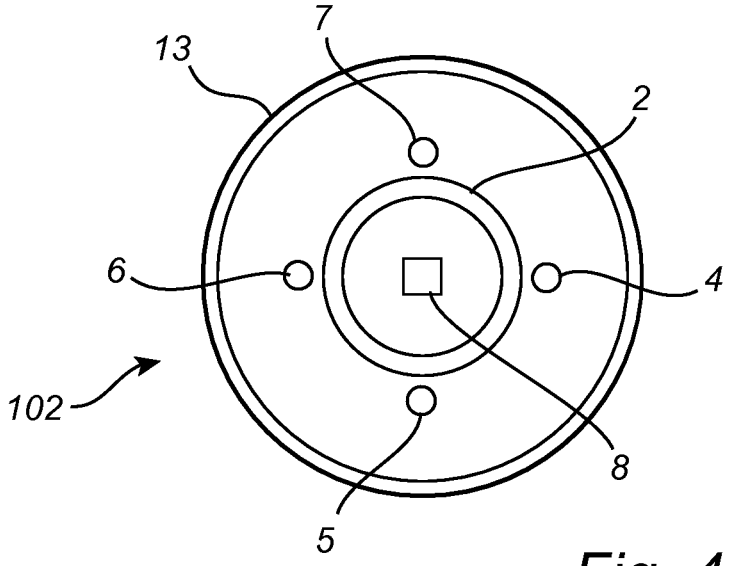
FIG. 4 shows a cross-sectional view of a fourth embodiment of a light emitting device according to the invention.

Turning now to FIG. 4, a cross-sectional view of a fourth embodiment of a light emitting device 102 according to the invention is shown and will be described only in terms of those features that differ from the embodiments described above.

The light emitting device 102 comprises four LED filaments 4, 5, 6, 7 each positioned at an angle of 90 degrees to the adjacent LED filaments and oriented parallel to the longitudinal axis A of the translucent core element 2. The light emitting device 102 further comprise one LED light source 8 arranged centrally inside the translucent core element 2, i.e. in the inner space 21 of the translucent core element 2.

In other embodiments more than four LED filaments may be provided positioned equally spaced around the translucent core element 2. In yet other embodiments the LED filaments need not be equally spaced or evenly distributed around the translucent core element 2.

Figure 5:
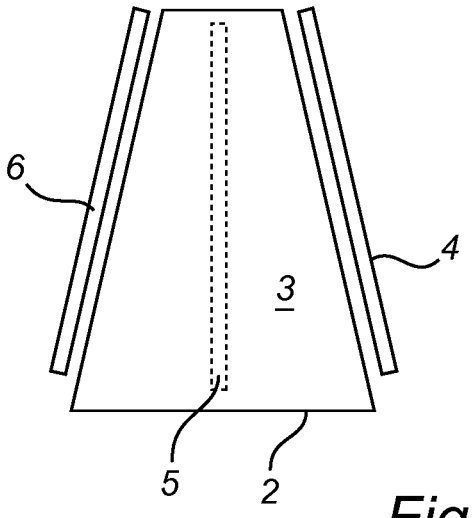
FIGS. 5-7 show perspective schematic illustrations of three different embodiments of a translucent core element of a light emitting device according to the invention and comprising LED filaments adapted to the shape of the translucent core element.
Figure 6:
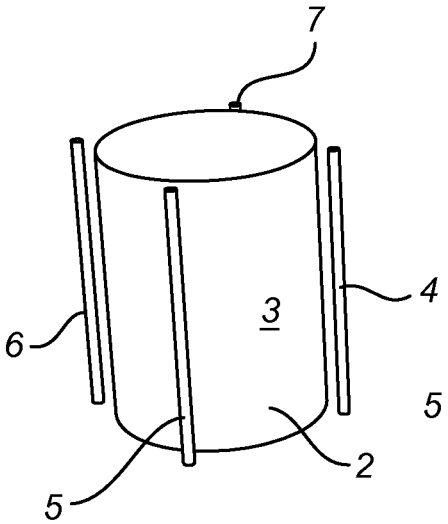
Figure 7:
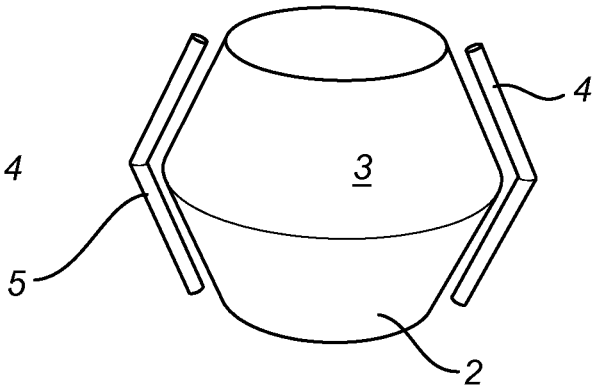

Turning now to FIGS. 5, 6 and 7 different feasible embodiments of the translucent core element 2 is illustrated along with different orientations of the LED filaments 4, 5, 6, 7 with respect to the translucent core element 2.

Generally, and irrespective of the embodiment, the translucent core element 2 may comprise a luminescent material.

Generally, the translucent core element 2 may have any feasible shape. For instance the translucent core element 2 may have a simple geometric shape, e.g. the shape of a cube, a ball, a cylinder (cf. FIG. 6) a dome, a sphere, a cone or a truncated cone (cf. FIG. 5).

The LED filaments 4, 5, 6, may be straight as shown in FIGS. 5 and 6. The LED filaments 4, 5, 6, may be tilted with respect to the longitudinal axis A of the translucent core element 2 as shown in FIGS. 1 and 5, or The LED filaments 4, 5, 6, may be extending vertically in parallel with the longitudinal axis A of the translucent core element 2 as shown in FIG. 6.

Generally, the translucent core element 2 may also have an advanced geometric shape, e.g. a trapezoid or a diamond, or even a combination of two or more geometrical shapes. An example of a translucent core element 2 with a more advanced geometrical shape is shown in FIG. 7.

The translucent core element 2 may also, alternatively or additionally, comprise two or more sections or parts. As indicated in FIG. 7 the translucent core element 2 may e.g. be provided with two sections such as to provide at least an outer surface 22 of the circumferential wall 3 with a surface with an angled curvature. The surface of the circumferential wall 3 or the curvature thereof may in other embodiments take other shapes such as a round curvature or a double curvature. Also surface of the circumferential wall 3 or the curvature thereof may be convex as indicated in FIG. 7, it may be concave or it may even be a combination of convex and concave.

Alternatively or additionally, the inner surface 23 of the circumferential wall 3 may also be provided with a curvature corresponding to or differing from that of the outer surface 22.

In particular embodiments, such as those shown in FIGS. 5 to 7, the LED filaments 4, 5, 6, 7 are extending and arranged such as to follow the curvature of the circumferential wall 3 of the translucent core element 2. Where provided, the further LED filaments 16, 17 may also be extending and arranged such as to follow the curvature of the circumferential wall 3, and particularly the inner surface 23 of the circumferential wall 3, of the translucent core element 2.

Figure 8:
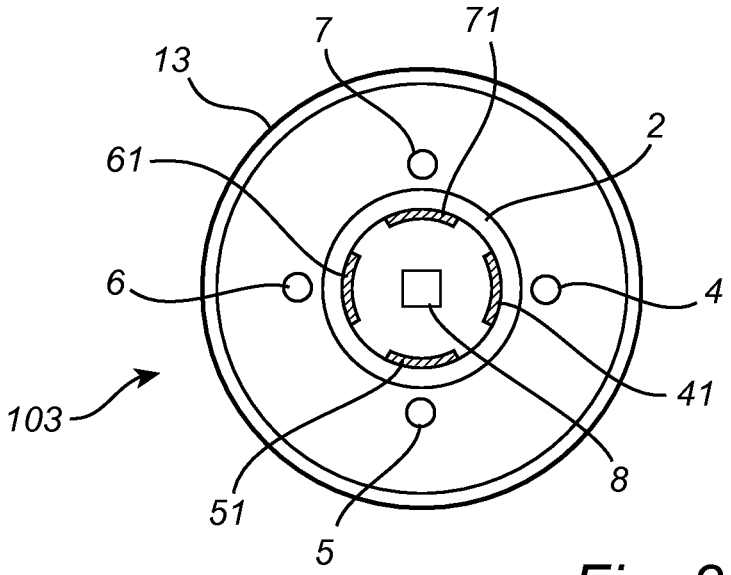
FIG. 8 shows a cross-sectional view of a fifth embodiment of a light emitting device according to the invention.

Turning now to FIG. 8, a cross-sectional view of a fifth embodiment of a light emitting device 103 according to the invention is shown and will be described only in terms of those features that differ from the embodiments described above.

Generally, a light emitting device according to the invention may comprise a translucent core element 2 which is generally more reflective and/or which provides more backscattering at the positions of the LED filaments 4, 5, 6, as compared to its remaining parts to increase the ratio of intensity between the LED filament and the translucent core element 2.

Figure 9:
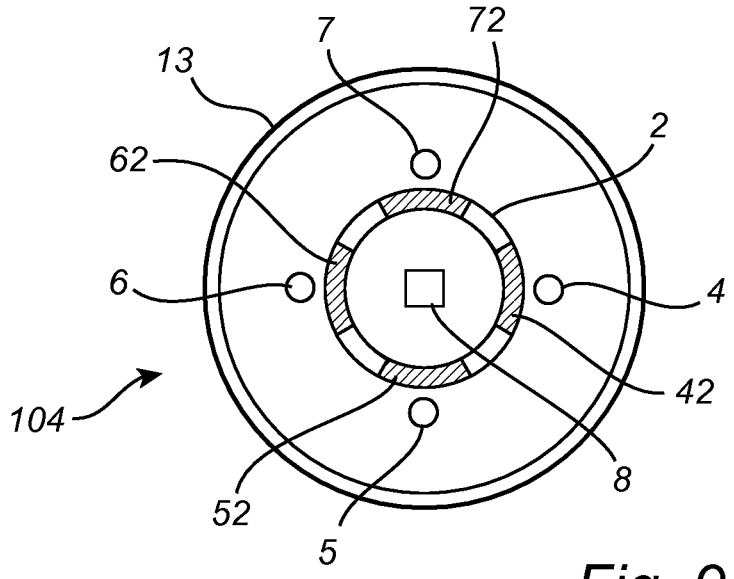
FIG. 9 shows a cross-sectional view of a sixth embodiment of a light emitting device according to the invention.

In the embodiment shown on FIG. 8, the light emitting device 103 comprises a translucent core element 2 comprising an additional at least partly reflecting layer 41, 51, 61, 71 at the position of each of the LED filaments 4, 5, 6, 7. The partly reflecting layers 41, 51, 61, 71 partly reflect the light from the LED light source 8. At the sections where no partly reflective layer is positioned more light is transmitted. The LED filaments 4, 5, 6, 7 may provide more light in a certain direction. The obtained effect of this embodiment is improved homogeneous light in the far field. It also contributes to the visibility of the LED filaments. Turning now to FIG. 9, a cross-sectional view of a sixth embodiment of a light emitting device 104 according to the invention is shown and will be described only in terms of those features that differ from the embodiments described above.

The light emitting device 104 comprises a translucent core element 2 comprising a higher concentration of scattering material 42, 52, 62, 72 at the position of each of the LED filaments 4, 5, 6, 7 as compared to the remaining parts of the translucent core element 2. Scattering materials include but are not limited to $TiO_2$, $BaSO_4$, $Al_2O_3$ or combinations thereof.

Figure 10:
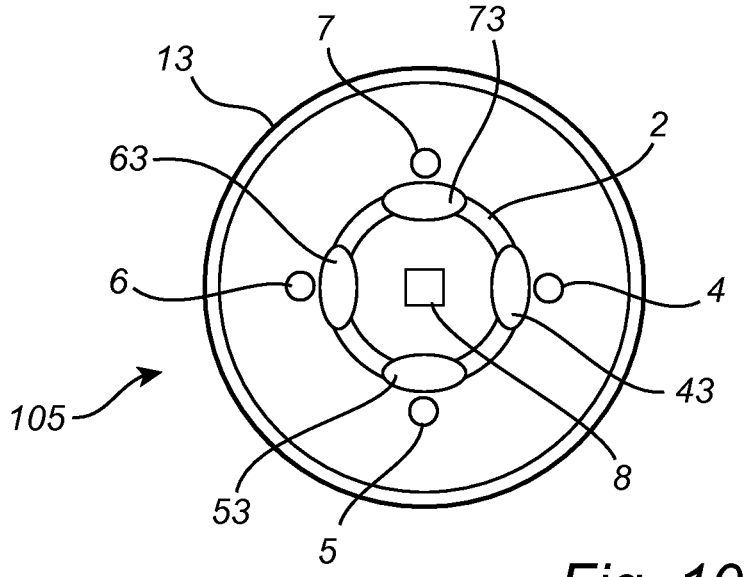
FIG. 10 shows a cross-sectional view of a seventh embodiment of a light emitting device according to the invention.

Turning now to FIG. 10, a cross-sectional view of a seventh embodiment of a light emitting device 105 according to the invention is shown and will be described only in terms of those features that differ from the embodiments described above.

The light emitting device 105 comprises a translucent core element 2 comprising a thicker wall 43, 53, 63, 73 at the position of each of the LED filaments 4, 5, 6, 7 as compared to the remaining parts of the translucent core element 2. A thicker wall increases the amount of scattering of the light. This embodiment can also be used to improve the light homogeneity in the far field and/or the visibility of the LED filaments.

Figure 11:
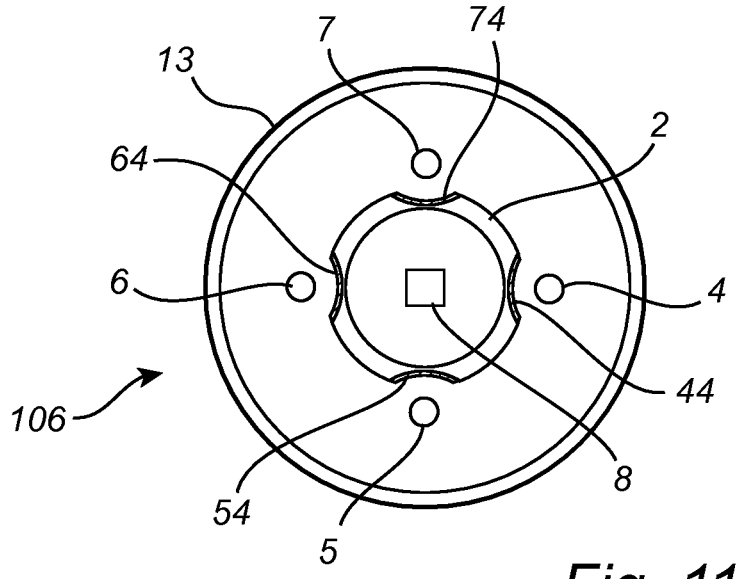
FIG. 11 shows a cross-sectional view of an eighth embodiment of a light emitting device according to the invention.

Turning now to FIG. 11, a cross-sectional view of an eighth embodiment of a light emitting device 106 according to the invention is shown and will be described only in terms of those features that differ from the embodiments described above.

The light emitting device 106 comprises a translucent core element 2 comprising small cavities 44, 54, 64, 74 at the positions of each of the LED filaments 4, 5, 6, 7 in order to redirect the second light emitted by the LED filaments 4, 5, 6, 7. This embodiment provides a more homogenous light in the far field and/or a better visibility of the LED filaments by reflecting and redirecting light emitted by the LED filaments 4, 5, 6, 7.

In the embodiment shown in FIG. 11, the LED filaments 4, 5, 6, 7 are at least partly positioned in the cavities 44, 54, 64, 74 in the translucent core element 2. Alternatively, the LED filaments 4, 5, 6, 7 may be positioned outside of the cavities 44, 54, 64, 74 in the translucent core element 2.

The cavities 44, 54, 64, 74 in the translucent core element 2 may be shaped and arranged such that they collimate the second light emitted by the LED filaments 4, 5, 6, 7. The cavities 44, 54, 64, 74 in the translucent core element 2 may also be shaped and arranged such that they distribute the light emitted by the LED filaments 4, 5, 6, 7 to larger angles than the incident angles.

Figure 12:
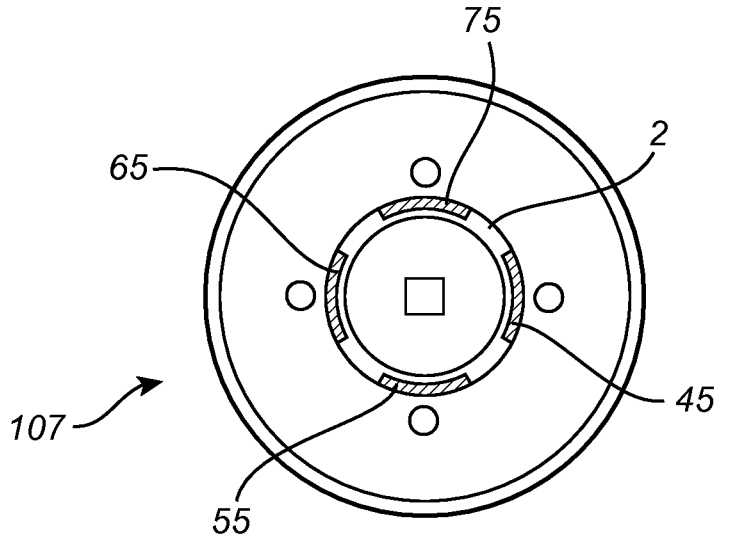
FIG. 12 shows a cross-sectional view of a ninth embodiment of a light emitting device according to the invention.

Turning now to FIG. 12, a cross-sectional view of a ninth embodiment of a light emitting device 107 according to the invention is shown and will be described only in terms of those features that differ from the embodiments described above.

The light emitting device 106 differs from the remaining embodiments described herein, and in particularly from the embodiment shown in FIG. 11, in that the cavities 44, 54, 64, 74 in the translucent core element 2 comprise a luminescent material 45, 55, 65, 75.

Turning now to FIGS. 13 to 16, four different types of light emitting devices according to the invention being adapted to be dimmable will be described in terms of the effect of the construction on the total lumen output of the light emitting device.

Each of FIGS. 13 to 16 shows a pairs of graphs illustrating to the left hand side the intensity of each of the LED light source and the LED filament as a function of the dimming level and to the right hand side the total lumen output as a function of the dimming level.

Figure 13:
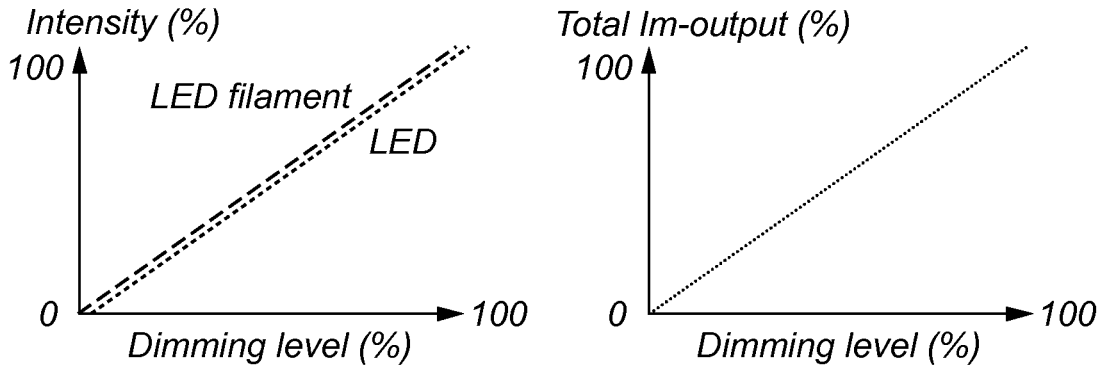
FIGS. 13-16 shows four pairs of graphs, the four pairs of graphs representing four different embodiments of a dimmable light emitting device according to the invention, and each pair of graphs illustrating to the left hand side the intensity of each of the LED light source and the LED filament as a function of the dimming level and to the right hand side the total lumen output as a function of the dimming level.

FIG. 13 illustrates a dimmable light emitting device configured such that the intensity of the LED filament and the LED light source positioned inside the translucent core element 2 may be increased and decreased (dimmed) simultaneously (left hand side graph). Thereby, a linear increase in overall lumen output of the light emitting device is obtained (right hand side graph).

Such a configuration may be combined with a LED filament positioned outside the translucent core element 2 and emitting second light having a higher color temperature than the first light emitted by the LED light source positioned inside the translucent core element 2. For example, the LED filament outside the translucent core element 2 may emit light having a color temperature of 3.500 K, while the LED light source inside the translucent core element 2 generates light having a color temperature of 2.500 K.

Figure 14:
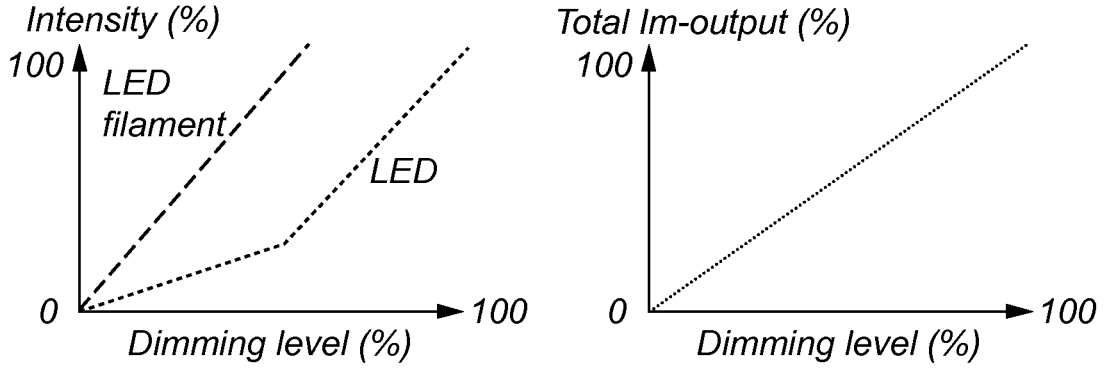

FIG. 14 illustrates a dimmable light emitting device configured such that there is a higher absolute increase in intensity of the LED filament compared to the absolute increase in intensity of the LED light source positioned inside the translucent core element 2 (left hand side graph), but a linear increase in overall lumen output of the light emitting device (right hand side graph).

Figure 15:
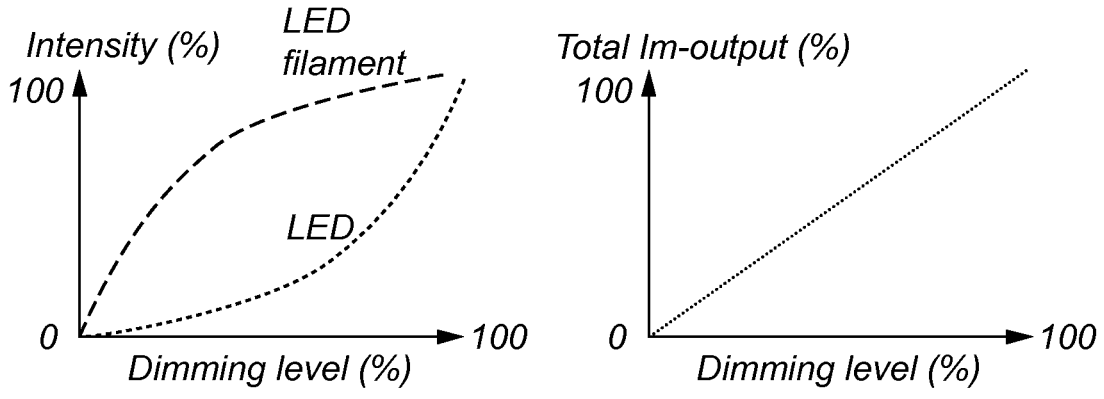

FIG. 15 illustrates a dimmable light emitting device configured such that there is a non-linear increase in intensity of the LED filament and a non-linear increase in intensity of the LED light source positioned inside the translucent core element 2 (left hand side graph), but a linear increase in overall lumen output of the light emitting device (right hand side graph).

Figure 16:
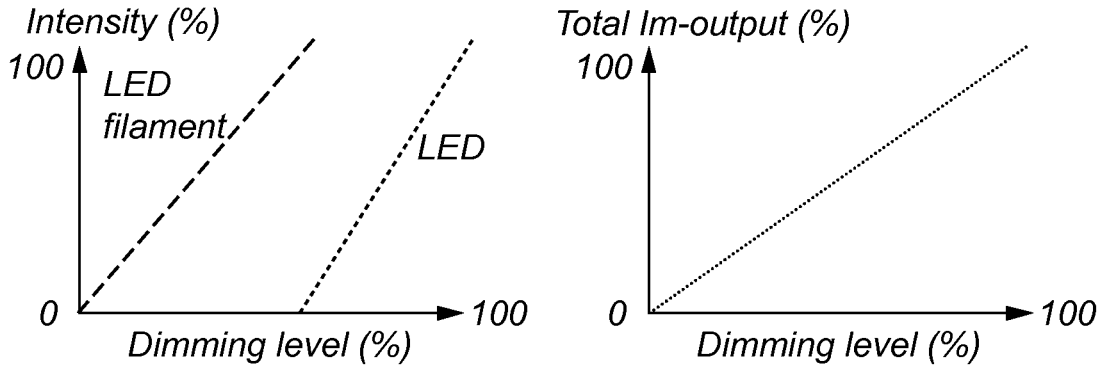

Finally, FIG. 16 illustrates a dimmable light emitting device configured such that at low intensities only the LED filaments are on and dimmed, and when the intensity increases the LEDs inside the translucent core element 2 start turning on (left hand side graph), but a linear increase in overall lumen output of the light emitting device (right hand side graph).

All of the configurations illustrated in FIGS. 14 to 16 may, for example, be combined with a LED filament emitting second light having a lower color temperature than the first light emitted by the LED light source arranged inside the translucent core element 2. For example, the LED filament outside the translucent core element 2 may emit light having a color temperature of 2.500 K, while the LED light source inside the translucent core element 2 generates light having a color temperature of 3.500 K.

All of the configurations illustrated in FIGS. 14 to 16 ensure that the LED filament becomes better visible at lower lumen levels. At higher lumen levels the prevention of glare, being the object of the present invention becomes important.

To control the LED filament and LED light source with respect to each other, a controller is needed. Thus, the light emitting device may comprise a controller to control the amount and type of light between the LED light source and the LED filament.

The LED light sources inside the translucent core element 2 may be colored LEDs. For example, three LED light sources in the form of a red (R), a green (G), and a blue (B) LED light source may be provided to tune the color temperature of the light coming out the translucent core element 2. One or more colored LED light sources may also be provided to emit colored light instead of white light. For example, the RGB LED light sources in the core element may emit reddish white light while the LED filament provides white light. The difference in color may provide more contrast for improving the visibility of the LED filaments without having glare issues.

The person skilled in the art realizes that the present invention by no means is limited to the preferred embodiments described above. On the contrary, many modifications and variations are possible within the scope of the appended claims.

For instance, it is also possible to include a light guide on top of the at least one LED light source.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting device having a longitudinal axis (A) comprising:

at least one LED light source adapted for, in operation, emitting first light, at least one LED filament adapted for, in operation, emitting second light, at least one translucent core element, the translucent core element comprising a circumferential wall, an inner space enclosed by the circumferential wall, and an outer bulb enclosing the at least one translucent core element and the at least one LED filament, wherein the at least one LED light source being arranged in the inner space enclosed by the circumferential wall of the translucent core element, and the at least one LED filament being arranged outside of the at least one translucent core element, and wherein the at least one translucent core element is centrally arranged on the longitudinal axis (A), wherein the circumferential wall of the translucent core element comprises a cavity at the position of the at least one LED filament, and wherein the cavities are shaped and arranged such as to collimate the second light emitted by an adjacent LED filament, or wherein the cavities are shaped and arranged such as to distribute the second light emitted by an adjacent LED filament to angles larger than the angles of incidence of the second light on the cavities.

2. A light emitting device according to claim 1, wherein the at least one LED filament is arranged on or at the translucent core element, or wherein the at least one LED filament is extending in parallel with the longitudinal axis (A), or the at least one LED filament is tilted with respect to the longitudinal axis (A).

3. A light emitting device according to claim 1, wherein the ratio of the intensity of the second light emitted by a LED filament to the intensity of the light emitted from the translucent core element is more than 3, more than 4, or more than 5.

4. A light emitting device according to claim 1, and comprising an additional plurality of LED filaments, the plurality of LED filaments being arranged equally spaced around the translucent core element.

5. A light emitting device according to claim 1, and comprising at least one further LED filament, the at least one further LED filament being arranged in the inner space enclosed by the circumferential wall of the translucent core element.

6. A light emitting device according to claim 1, wherein the translucent core element comprises a scattering material, and wherein the concentration of the scattering material is higher at the position of the at least one LED filament than at the remaining part of the translucent core element.

7. A light emitting device according to claim 1, wherein the translucent core element comprises a higher reflectivity or is more backscattering at the position of the at least one LED filament than at the remaining part of the translucent core element.

8. A light emitting device according to claim 1, wherein the circumferential wall of the translucent core element comprises a larger thickness at the position of the at least one LED filament than at the remaining part of the translucent core element.

9. A light emitting device according to claim 1, wherein the at least one LED filament is arranged at least partially within the cavity.

10. A light emitting device according to claim 1, wherein at least one of the translucent core element and the cavity comprise a luminescent material.

11. A light emitting device according to claim 1, wherein a part of the translucent core element comprises a higher transmissivity than the remaining part of the translucent core element.

12. A light emitting device according to claim 1, wherein at least an outer surface of the circumferential wall of the translucent core element is parallel with the longitudinal axis (A) and/or comprises a curvature in the longitudinal direction (L) or is inclined with respect to the longitudinal axis (A), and wherein the at least one LED filament extends in parallel with the outer surface of the circumferential wall of the translucent core element.

13. A lamp comprising a light emitting device according to claim 1.

* * * * *